United States Patent [19]

Grass

[11] 4,434,523

[45] Mar. 6, 1984

[54] DOOR HINGE FOR FURNITURE DOORS OR THE LIKE

[76] Inventor: Alfred Grass, Konsumstrasse 20, A-6973 Höchst, Austria

[21] Appl. No.: 285,265

[22] Filed: Jul. 20, 1981

[30] Foreign Application Priority Data

Nov. 14, 1980 [AT] Austria ..... 5623/80

[51] Int. Cl.[3] ..... E05D 7/04

[52] U.S. Cl. ..... 16/242; 16/247; 16/382

[58] Field of Search ..... 16/247, 242, 243, 246, 16/248, 249, 239, 382

[56] References Cited

U.S. PATENT DOCUMENTS 4,290,167 9/1981 Lautenschlager ..... 16/429

*Primary Examiner*—Mark Rosenbaum

*Attorney, Agent, or Firm*—Parmelee, Miller, Welsh & Kratz

[57] ABSTRACT

A semi-concealed hinge has been provided for mounting a door in a relatively close adjustable operating relation with a furniture side rail or frame. A socket part is adapted to be substantially fully positioned within a backwardly and edgewise open slot in the door to carry a swing arm part on a hinged knuckle, in such a manner as to enable the door to be pressure-retained in a desired position, such as in a closed position. A connector or screw-on bracket-like plate is either integral with or secured to the swing arm part and, if it is a separate part, has a screw and slot mounted relation with the swing arm part that enables "up" and "down" adjustment of the door with respect to the frame. The connector or screw-on plate has opposed guide flange portions that are adapted to fit over and to be carried along opposite sides of the frame, and to cooperate with an inwardly positioned adjustment plate. The adjustment plate has an elongated slot and the connector plate has a central hole for receiving a frame mounting screw that adjustably operatively secures the plates on a side edge of the frame. The adjustment and connector plates have cooperating sloped or wedge surfaces which enable the connector plate to be moved inwardly and outwardly with respect to the frame in such a manner as to effect a fully parallel adjustment of the door along the front face of the frame.

6 Claims, 11 Drawing Figures

DOOR HINGE FOR FURNITURE DOORS OR THE LIKE

The invention concerns a door hinge, preferably a half-hidden jointed hinge for furniture doors or the like that has up and down (in and out) and sideways movable carrier parts, connected by means of screws door-body-sides to a screw-on connector plate and a flexible ball cup or socket part attached to the carrier parts and that, if desired, may be provided with integrated pressure-closing and/or open-holding elements.

An already known application displays an initially described door hinge which has, on the one hand, door-sideways a carrier arm developed into the steering-part for a pressure-closing and/or open-holding device, while, on the other hand, the same carrier arm is movable on two levels and fastened to a screw-on plate.

There, the adjustment of levels ensues through a vertical shift of the carrier arm on a screw-on, screw-mounted foundation plate, using a slightly slackened setting-up screw. Sliding movement is manageable between cog and groove with slight play. The arm carrier may be removed from the screw-on plate by removing the hinges from a cog and groove relation with the setting-up screw slackened even further.

In the already known application, the carrier arm has for sidewise adjustment a pressure screw, which is set free by pressing at its bolt-side end from the screw-on plate, tolerating a slight shift through tilting of the carrier arm.

While level adjustment and the simple putting on hinges of the furniture door in connection with the automatic closing pressure-device proved excellent in usage, the side adjustment for a sidewise correction of the door offers too slight an adjustment possibility. Besides, a setting-up screw and a pressure screw have to be set in action alternately for adjustment. Furthermore, a great deal of the closing friction is lost between the flat surfaces with the carrier arm tilting on the screw-on plate. Both screws have to compensate for this friction loss through mutual bracing. The attendant danger of this is that neither the screw head, nor the press-screw front fit flatly on their appointed surfaces in order to become integrated into the material in this way. The hinge may become detached; in addition, pressed-in hinge surfaces do not correspond to the quality standards of modern furniture production. Moreover, an unwanted tilt may occur in case of a sidewise correction as far as the height is concerned as well.

The object of the present invention is to develop a door hinge in such a way that the sidewise adjustment will allow for a greater adjustment range, may be achieved independently of height adjustment, and such that adjustment-corrections can be carried out easily.

The solving of the problem is achieved by certain means, available between a screw-on plate and the body-frame front which permit varying the distance between the furniture-frame front and the screw-on plate inner surface, parallel on the horizontal and vertical levels, for the sidewise adjustment of the furniture door, and importantly preserving the parallelism.

Accordingly, an essential feature of the invention is a half-hidden jointed hinge with an integrated closing device, and which enables a separately adaptable height and side adjustment.

An important advantage of the present invention is its side adjustment by means of parallel shifting. A characteristic feature, shared by all the examples executed, is that inclined surfaces (wedge surfaces) of a first part are adjusted with respect to attached surfaces of a second or glide part in such a manner that manually executed longitudinal shifting of the first part brings about a transverse motion of the second part in a 90° changed direction. This transverse motion is sidewise adjustment motion whose raising adjustment value depends on the wedge angle of the inclined surface. The self-stopping which is absolutely necessary with the fixing of a set position through the clamping together of the first and second parts, determines the wedge angle. The possibility of a sidewise adjustment of plus 1to minus 2 mm is sufficient in most cases, but may be increased correspondingly through optional wedge surfaces.

In a preferred initial embodiment or execution, several wedge surfaces may be present as slides on an adjustment plate which props up adjoining edges of a screw-on plate to be adjusted.

The prop or glide edges may be formed by hollowings out, etc., and act simultaneously as self-supports for the securing wedges.

In a second embodiment or execution example there are edge surfaces instead of the glide edges of the screw-on connector plate to be adjusted, which may be either molded into the material on the adjustment plate or formed by protruding bent-over flanges, with corresponding wedge angles.

In the first and second embodiments, the adjustment plate is mounted movable on the furniture-frame front, i.e. on the inner surface, circumscribing the width in the clear of the inner area of the furniture piece. The adjustment plate with its two-side outer surfaces can be inserted at the same time between metal prongs or shanks of the screw-on plate and/or may be mounted with a longitudinal slide and guided with bend-over flanges forming the wedge surfaces with the already described hollowed-out cavities of the screw-on plate.

The adjustment plate protrudes above and below the screw-on plate for manual longitudinal shifting. A slot in the adjustment plate determines the shifting course, while a clamp screw shaft serves as the guide. The clamp screw has to be loosened before shifting. It passes through screw-on and adjustment plates and can be screwed either directly into the furniture wood or into an edge or rail portion thereof.

After correction of the wedge surfaces in a sidewise adjustment direction, the clamp screw can be again pulled up. The entire system is, as already mentioned, immovably stabilized through self-stopping.

The adjustment plate has, in a different embodiment, a circular form (see FIGS. 9 and 10). Accordingly, the wedge surfaces are placed on the circumference of a disk, preferably in a triple arrangement. The corresponding wedge surfaces of the screw-on plate are also shaped in a circular fashion. A disk-shaped adjustment plate with a concentric slot is placed on a clamp-screw shaft and twisted by means of a hand lever for sidewise adjustment. To this purpose, the lever may protrude above and below the screw-on plate or project sidewise through a hollowing-out in the screw-on plate.

It is of advantage to have the screw-on plate U-shaped in cross-section, with the inner distance between the shanks forming a U-shape that is somewhat wider than the furniture frame. To this purpose, the shanks are bent at right angles to the screw-on plate which provides means for parallel shifting and clamping against the furniture-frame front. The shank that is connected with the hinge carrier arm is preferably longer than the opposite parallel shank, to serve as an extension of the carrier arm. Both shanks may be, however, of equal length. An essential advantage is achieved when both these parallel shanks, with respect to the distance between their inner surfaces, form a guide on front and back furniture frame surfaces.

The connection between screw-on plate and carrier swing arm may be accomplished by means of a screw. A vertical slot in the carrier arm, through which the screw-shaft passes, allows for height adjustment, and a notch at a right angle to the slot enables a more rapid connecting of the screw-on plate body-sides and the door-side arm, in accordance with the original application.

A further execution form or embodiment (see FIG. 11) of the sidewise adjusting screw-on plate according to this invention is proposed in such a way that the doorside shank of the screw-on plate serves as a one-piece swing bracket or arm, while the shank end clasps the hinge joint of the door mounted socket or cup to, in this way, supply the hinge joint with a pressure-closing-steering-part (steering curve).

There is only a minimal intermediate space between the furniture door and furniture frame in a closed position. The furniture door-side shank should be dimensioned according to stress. A self-support in the socket screw-on plate allows for the required material strength of this shank. It is reduced in the socket area according to the interior space provided.

In a different embodiment, the wedge surface extends over the entire lengths of the adjustment and screw-on plates (FIG. 8).

Below, the invention is explained in reference to the figures.

Figure 1:
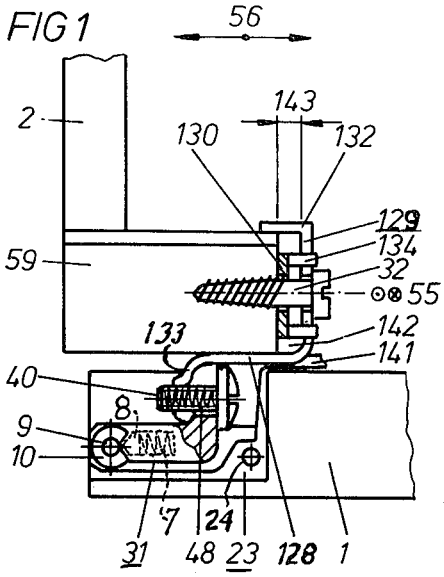
FIG. 1 shows a top plan view, partially in section of a hinge construction and shown mounted in accordance with the invention.

FIGS. 1 to 7 show a preferred embodiment of a door hinge construction according to the invention. A door-side mounted socket or cup part 23 has an integrated curved guide element 10 for pressure closing and keeping a door 1 open. A swingably attached carrier or swing arm 31 is adapted to be secured to a body-side screw-on or connector plate part 129 which cooperates with an adjustment plate 130 for adjusting movement in the direction of arrows 56 of FIG. 1 to provide endwise adjustment of the door 1 with respect to a rail or frame member 59 of a piece of furniture 2. The plates 129 and 130 are shown secured in an adjusted, fixed mounted position by a clamping mounting screw 32. Furniture door 1 may be set as to its height, longitudinal or up and down with height adjustment meansrepresented by screw 40 that is mounted in a threaded bore 138 in a tab portion 133 of the screw-on plate 129, and an elongated slot 48 in a tab-like front end portion of the carrier arm 31. Clamping screw 32 is drawn only sufficiently tight such that door stability is achieved.

Figure 5:
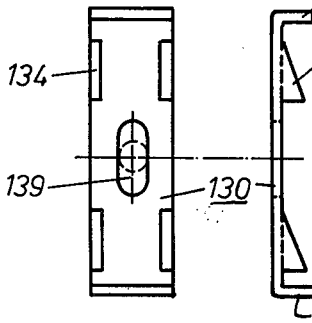
FIG. 5 is a front plan view of an adjustment plate of the hinge of FIGS. 1 and 2.
Figure 6:
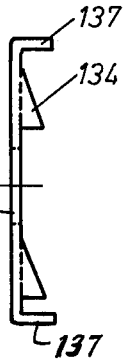
FIG. 6 is a side edge view of the adjustment plate of FIG. 5.
Figure 4:
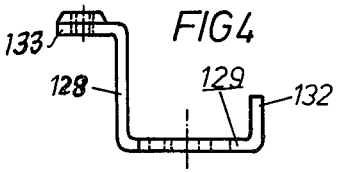
FIG. 4 is a side edge view of the connector plate of FIG. 3.
Figure 7:
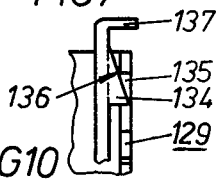
FIG. 7 is a side edge fragmental view showing an operating positioning between the connector and the adjustment plates of the embodiment of FIGS. 1 and 2.

It is quite disturbing when the distance between adjacently arranged doors or the distances to the outer surfaces of vertical furniture sides 2 are not of the same size. These inexactitudes may be rapidly corrected with sidewise-adjustment according to the present invention. For sidewise or lateral, in and out adjustment in the direction of arrows 56 of FIG. 1, distance or spacing (see arrows 143) between the screw-on or connector plate 129 and a lateral front side 142 of a furniture or cabinet rail or frame member 59 may be parallelly varied. This parallel adjustment is assured by the fact that an adjustment plate 130 at the front side of the furniture rail or side frame ledge 59 is arranged to slide in the direction of arrows 56. Adjustment plate 130 has slanted wedge surfaces or lugs 134 attached to or integral with and extending from a side facing towards the screw-on plate 129. Preferably, a pair of two or more of these wedge surfaces or lugs 134 are provided on the adjustment plate 130 at its upper and lower reaches, as FIGS. 5, 6 and 7 show. The wedge surfaces or lugs 134 may be formed by means of cut and bent-out side edge flanges on the preferably punched-out and bent adjustment plate 130.

All wedge surfaces or lugs 134 display the same angle slant in the same direction. In the already described working position of the adjustment plate 130, slanted or wedge surfaces or lugs 34 cooperate with, engage within or catch hold through and are guided by corresponding slots or slits 136 in the screw-on plate 129 (see FIG. 7) that is positioned in a cooperating frontal position with respect to the plate 130. The slanted wedge surfaces or lugs 134 are guided within and by adjoining edges or surfaces of the slots 136 in the screw-on plate 129 to thus support each other. The edges and surfaces of the slots 136 of screw-on plate 129 may be punched-out to provide window-like pairs of perforations 135 in the screw-on plate 129.

The screw-on plate 129 and the adjustment plate 130 are secured by fastening screw 32 extending through an elongated passage slot 139 in the plate 130 and a hole 140 in the plate 129.The hole 140 extends substantially centrally through the screw-on plate 129 which is circular with only a few millimeters of play between it and the shaft of the screw 32, so that the screw-on plate 129 is held against shifting in the direction of the arrows 55. The adjustment plate 130 is, on the other hand, endowed with an elongated passage slot 139 which extends along the middle of its longitudinal extension and provides for manual shifting or adjustment of the adjustment plate in the direction of arrows 55 along penetrative shaft of the screw 32. To this end, adjustment plate 130 is longer than the screw-on plate 129, such that its end flanges 137 extends over and above the screw-on plate 129 in the direction of 55, at least to the extent necessary for its longitudinal or endwise adjustment shift between top and bottom, bent-over end flanges 137 (see FIG. 2).

It will be noted that the frame mounted screw-on, connector plate 129 also has a pair of spaced-apart, inside shank or flange portions 128 and 132 (see FIGS. 1 and 4) which extend backwardly therefrom and serve as limit stop means as well as slide guide means for "in" and "out" (see arrows 143 of FIG. 1) adjustment movement along opening-defining rail, ledge or frame member 59 of the furniture or cabinet 2. Portions 128 and 132 guide lateral or sidewise adjustment movement of the door 1 when the adjustment plate 130 is moved along its slot 139 on the (loosened) screw 32 to enable moving the wedges 134 of the plate 130 along end edges of the slots 136 of the frame mounting plate 129. In this manner, the plate 129 may be moved either towards or away from the plate 130 and the frame rail member 59. Thus, the furniture opening-defining rail or frame member 59 acts as a base for lateral or sidewise adjustment of the door 1 in arrow directions 56 of FIG. 1. Door-side tab or foot portion 133 of the screw-on bracket or plate 129 is mounted on a swing or carrier arm 31 of door-mounted socket part 23 by a machine screw 40 that extends through a threaded hole 138 in tab portion 133 of the bracket or plate 129.

Figure 2:
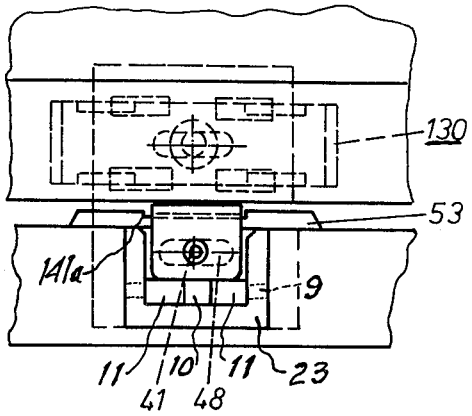
FIG. 2 is a view taken from the left side of, on the scale and of the hinge embodiment of FIG. 1.
Figure 3:
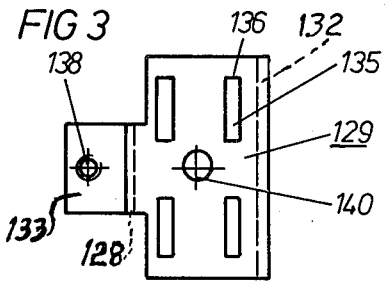
FIG. 3 is a front plan view of a connector or screw-on plate employed in the construction of FIGS. 1 and 2.

FIGS. 1 and 2 show that it is of advantage to supply the cup-shaped socket part 23 with a shelf-like support flange 141 which has a central offset or recess portion 141*a* to receive and by-pass shank portion 128 of the plate 129. The socket part 23, as shown in FIG. 1, is mounted in an edgewise and backwardly open cut-out window or slot in the back side of the door 1. The construction of the present invention employs a door-mounting socket or box part 23 of U and angle-shaped construction. As illustrated particularly in FIGS. 1 and 2 of the drawings, the box or socket part 23 may be secured in position with the door 1 by means of screws which extend through a pair of holes 24 in opposite side wall portions thereof into the side walls of the cut-out portion of the door. The socket part 23 at its back end, adjacent the open side edge or end of the door 1, carries an upstanding, cross-extending, rounded, guiding curve portion 10 that has a depression or recess therein to receive a wedge-shaped tipped end of a sleeve-like pressure element 8. The pressure element 8 is operatively carried within the body of intermediate connecting, carrier or swing arm part 31 and is flexibly urged forwardly by an internally mounted spiral spring 7. In FIG. 1, it will be noted that the slot in the guide curved portion 10 is in receiving relation with the tip of the element 8 to provide a flexible door closing position of the elements. These operating features are disclosed in my co-pending U.S. application Ser. No. 149,275 of May 12, 1980, now U.S. Pat. No. 4,368,558 of Jan. 18, 1983.

Intermediate connecting, pressure element carrying, swing or carrier arm part 31 at its front end has a pair of knuckles 11 (see FIG. 2) which carry a through-extending pivot pin 9 that extends through the curved guide part 10 to pivotally mount the arm part 31 with respect to the socket part 23. It will be noted from FIG. 2 that an elongated slot 48 is provided in the swing arm part 31 through which the screw 40 extends to enable longitudinal adjustment of the plate 129 with respect to the swing arm part 31. After a suitable adjustment has been made, screw 40 is adapted to be tightened-down within the threaded hole 138 in the tab portion 133 of the plate member 129. The amount of adjustment between the arm part 31 and the screw-on plate member 129 is governed by the clearance spacing between side edges of the plate member 129 and the spacing between the side walls of the socket part 23, as indicated in FIG. 2.

Figure 8:
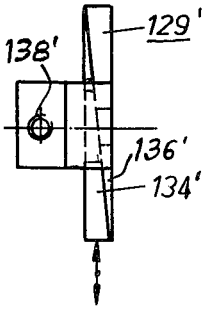
FIG. 8 is a side elevation of a second embodiment in which cooperating wedge surfaces are provided on both the connector and the adjustment plates to extend along their full lengths.

In the embodiment of FIG. 8, screw-on plate 129' and adjustment plate 130' may each be provided with slanted wedge surfaces 134', 136' that extend over their entire lengths and slidably cooperate with each other.

Figure 9:
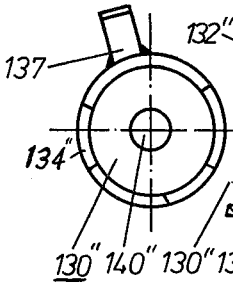
FIG. 9 is a plan view of a third embodiment of the invention using a circular adjustment plate.
Figure 10:
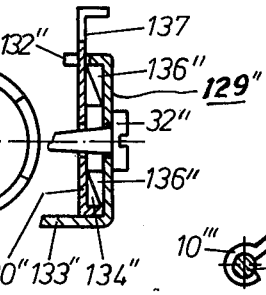
FIG. 10 is a section showing the circular adjustment plate of FIG. 9 in a mounted position with respect to a connector or screw-on plate.

FIG. 9 shows another embodiment in which a circular adjustment plate 130'' is a circular disk with corresponding curved wedge surfaces 134'' along its peripheral edge in a triple arrangement. The surfaces 134'' cooperate with adjoining or opposed wedge surfaces 136'' of screw-on connecting plate member 129''. The circular adjustment plate 130'' is pivoted at its central bore 140'' on the shaft of setting-up screw 32'', and is manually rotated by means of an attached adjustment lever finger 137 which passes through a guide slot 132'' in the connecting plate member 129''. The plate member 129'' moves in the direction of arrows 56 of FIG. 1 through the sliding against one another of the slanted wedge surfaces 134'', 136'' (see FIG. 10).

Figure 11:
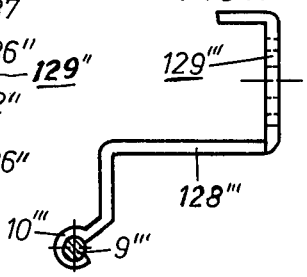
FIG. 11 is a side edge view showing a carrier or swing arm and screw-on or connector plate as a single or integral or one piece member.

FIG. 11 shows a modified screw-on connecting, bracket-like plate member 129'''. Its doorside leg or shank 128''' is not screw-mounted on a swing arm such as 31 of FIG. 1, but is formed as a one-piece door carrier and swing arm part or member that extends to provide an end hinge portion 10''' which may be adapted to cooperate with a pivot pin 9''' to enable door opening and closing movement. The pin 9''' is carried by and between a pair of spaced-apart collar portions at the inner end of the socket part 23 (see the portions 11 of the embodiment of FIG. 2) is substantially the same manner as the pin 9 of such embodiment.

I claim:

1. An improved semi-concealed door hinge for mounting between a frame and a door wherein the door has a receiving slot portion that is open to a back side thereof which comprises, a socket part adapted to fit in the slot portion of the door, means for securing said socket part in position within the slot portion, a connector plate, a swing arm extending from said connector plate and swingably connected to said socket part for door opening and closing movements with respect to the frame, an adjustment plate having spaced-apart wedge-shaped projecting portions on a face thereof, said connector plate having offset portions in a cooperatively aligned and engaging relation with said wedge-shaped projecting portions, one of said plates having opposed side-positioned flange means positioned along opposite side edges of the other of said plates for accurately aligned sliding adjusting movement between said plates to move said adjustment plate on said wedge-shaped projecting portions in an "in" and "out" relation with respect to said connector plate and provide lateral adjustment of the door with respect to the frame, single screw means adapted to extend through said connector and adjustment plates for securing them in an adjusted relation with respect to each other on the frame in such a manner that the door may be adjusted and retained in a parallel relation with respect to the frame and said adjustment plate being rotatably adjustable with respect to said connector plate.

2. An improved hinge as defined in claim 1 wherein, said adjustment plate has a circular portion and an operating finger projecting therefrom, said connector plate has a cooperating circular portion, and said circular portions have slidably cooperating curvilinear wedge faces that are adapted to move said adjustment plate towards and away from said connector plate when said adjustment plate is turned by said operating finger with respect to said connector plate.

3. An improved semi-concealed door hinge for mounting between a frame and door wherein the door has a receiving slot portion that is open to a back side thereof which comprises, a socket part adapted to be secured within the slot portion of the door, a swing arm connected at one end to said connector plate and swingably connected to said socket part for door opening and closing movements with respect to the frame, a movable adjustment plate having at least a pair of longitudinally spaced-apart aligned wedge-shaped projections extending from a face thereof, said connector plate having at least a pair of spaced-apart and aligned slot portions therein that are adapted to receive and cooperatively align said wedge-shaped portions of said adjustment plate therein, said adjustment plate having a centrally located elongated hole therein and said connector plate having a hole therethrough, screw means adapted to extend through the holes in said plates and into the frame for mounting and retaining said plates in an adjusted relation with respect to each other on the frame, said adjustment plate being adapted when the screw means is loosened to be moved in an aligned substantially parallel "in" and "out" adjusted relation with respect to said connector plate and to be retained in a parallel fully aligned relation with respect to said connector plate for providing a lateral adjustment of the door with respect to the frame and said swing arm having a slidably adjustable means connecting it to said connector plate for adjusting the door longitudinally "up" and "down" with respect to the frame.

4. An improved door hinge as defined in claim 3 wherein said connector plate has opposed spaced-apart side-positioned flange means along opposite sides of said adjustment plate for aligned-sliding adjusting movement between said plates.

5. An improved semi-concealed door hinge for mounting between a frame and a door wherein the door has a receiving slot portion that is open to a back side of the door which comprises, a socket part adapted to fit and to be secured within the slot portion of the door, a connector plate, an angle-shaped swing arm extending from said connector plate and swingably connected to said socket part for providing door opening and closing movements with respect to the frame, slidable adjustment means between said connector plate and said swing arm for adjusting a longitudinal "up" and "down" position of the door with respect to the frame, said connector plate and adjustment plate having a cooperating group of alignment maintaining wedging surface portions for adjusting an "in " and "out" lateral position of the door with respect to the frame, means for retaining said swing arm in an adjusted relation with respect to said connector plate and for retaining said connector and adjustment plates in their adjusted relationship with respect to each other, and said connector and adjustment plates being adapted to be securely mounted on the frame in their adjusted relation by one of said retaining means.

6. An improved door hinge as defined in claim 5 wherein said swing arm and said socket have cooperating means for urging the door towards and retaining it in a desired position with respect to the frame.

* * * * *